US005460151A

United States Patent [19]

Hamilton, Jr. et al.

[11] Patent Number: 5,460,151

[45] Date of Patent: Oct. 24, 1995

[54] ARROW REST

[76] Inventors: William A. Hamilton, Jr., 109 Monroe Ave.; Dale Leroux, 5 Roy Ave., both of Westbrook, Me. 04092

[21] Appl. No.: 172,905

[22] Filed: Dec. 27, 1993

[51] Int. Cl.[6] ..... F41B 5/22

[52] U.S. Cl. ..... 124/44.5

[58] Field of Search ..... 124/23.1, 24.1, 124/25.6, 44.5, 86, 87, 88

[56] References Cited

U.S. PATENT DOCUMENTS

| | | | |
|---|---|---|---|
| 3,285,237 | 11/1966 | Wolfe | 124/44.5 |
| 4,324,221 | 4/1982 | Peck | 124/24.1 |
| 4,791,907 | 12/1988 | Corley | 124/44.5 |
| 4,967,722 | 11/1990 | Roberts | 124/44.5 |
| 5,031,601 | 7/1991 | Gunter | 124/44.5 |
| 5,085,201 | 2/1992 | Tepper et al. | 124/44.5 |
| 5,213,090 | 5/1993 | Tone | 124/44.5 |
| 5,261,383 | 11/1993 | Halamay | 124/44.5 |
| 5,327,877 | 7/1994 | Shaw | 124/24.1 |

*Primary Examiner*—John A. Ricci
*Attorney, Agent, or Firm*—Frederick R. Cantor

[57] ABSTRACT

An arrow rest for an archery bow is formed by a stationary shaft extending transversely across the bowstring movement plane, and a single roller rotatably mounted on the shaft. The roller has an annular groove that forms two axially spaced flanges engageable with the undersurface of an arrow shaft. During the arrow launching process the arrow side surface rides along the edges of the roller flanges so as to cause the roller to spin around the shaft axis. The roller includes a roller body formed of an elastomeric material so that frictional contact between the arrow and the roller body flanges is essentially noiseless.

1 Claim, 1 Drawing Sheet

ARROW REST

BACKGROUND OF THE PRESENT INVENTION

The present invention relates to arrow rests.

The present invention, more particularly, relates to an arrow rest mountable on a conventional archery bow to support an arrow while the string is being drawn back and then released to launch the arrow. The arrow rest is mounted on the handle riser section above the handgrip portion of the bow to provide two spaced arrow support surfaces engageable with the undersurface of an arrow.

Various arrow rest constructions have been proposed. In one commonly used construction, the arrow rest comprises an arm extending upwardly from a cantilever bracket to engage the undersurface of the arrow at about the seven o'clock position, and a plunger extending from the bow handle riser portion at about the three o'clock position. This construction is sometimes referred to as a "shoot-through" type construction.

In another commonly used arrangement, the rest comprises a plunger engageable with the arrow at the three o'clock position, and a curved wire arm extending from the plunger around the undersurface of the arrow to contact the arrow at the seven o'clock position. This arrangement is sometimes referred to as the "shoot-around" type.

Another type of arrow rest comprises two laterally spaced prongs extending from a transverse support shaft to engage the arrow at about the five o'clock and seven o'clock positions. The prongs are located equidistant from a vertical midplane taken through the arrow centerline. The arrow rests on the tips of the prongs.

The frictional engagement between the arrow side surface and the arrow rest surfaces often produces a discernible noise, which is objectionable when the person is using the bow and arrow for game hunting purposes. The deer, or other animal being hunted, can often hear the noise and jump or otherwise move out of the path of the launched arrow.

There has been developed a relatively noiseless arrow rest that apparently overcomes disadvantages of the conventional arrow rest constructions. The rest that is of interest comprises two small wheels having their movement planes angled at about forty-five degrees to a vertical midplane passing through the arrow centerline. Edge areas of these small wheels engage the arrow undersurfaces at two spaced points located, respectively, at the four-thirty o'clock position and the seven-thirty o'clock position.

The advertising literature for this multi-wheel arrow rest indicates that the wheels are formed of a plastic material having a rubber tire covering; the wheels are said to be smooth-rolling and silent. Apparently the multi-wheel arrow rest comprises a retractable mounting structure, whereby the wheels drop down out of the way during the arrow launch action, so as to prevent contact between the arrow fletches and the arrow rest componentry.

SUMMARY OF THE PRESENT INVENTION

An object of the present invention is to provide an arrow rest.

A further object of the present invention is to provide a simplified arrow rest, that comprises a single roller positioned directly under the arrow. An annular groove is formed in the roller body so as to define two axially spaced circular flanges. The width of the groove is such that the arrow is enabled to have a stable position resting on the edges of the axially spaced flanges.

During an arrow launch action the arrow shaft moves over the edges of the roller flanges so as to cause the roller to spin on its rotational axis. The single roller has a relatively small mass so that a relatively small expenditure of energy is involved in spinning the roller. The velocity of the arrow is essentially unaffected by the small energy expenditure.

The roller body is formed out of a high durometer rubber or elastomeric material, such that the edges of the roller flanges grip the arrow surface, thereby causing the roller to spin. The rolling contact between the rubber flanges and the arrow surface is noiseless. When the equipment is used for game hunting purposes there is a lessened danger that the animal will be startled by frictionally produced noise generated by the arrow rest.

In a preferred form of the present invention the elastomeric roller body is carried on a sleeve formed out of a rigid plastic material, e.g. polytetrafluoroethylene. The rigid plastic sleeve forms an annular bearing that rotates freely on the associated stationary shaft. The shaft can be formed of various materials, e.g. brass, stainless steel, or a rigid plastic material, e.g. polytetrafluoroethylene.

The roller is designed so that the rigid plastic sleeve has a relatively long axial length, e.g. at least about one half inch. The relatively long sleeve length provides a satisfactory bearing surface that promotes the desired roller spinning movement, without a tendency to wobble out of the spin plane. The spinning action of the single roller is believed to be superior to that of the aforementioned prior art multiple wheels. Such wheels, as depicted in the advertising literature, have relatively small bearing surface areas. Further, it is believed that such wheels would tend to wobble, due to the small bearing surface areas.

The arrow rest should be capable of some lateral adjustment in order to insure that the arrow is aligned with the center of pressure of the bow and arrow system. The "center of pressure" is generally understood to mean an imaginary line of movement of the nock point on the string as the string moves to launch the arrow. Often small adjustments of the arrow rest are required to insure that the rest is aligned with the center of pressure. Lateral adjustment of the arrow rest is also desirable for the purpose of compensating for an individual archer's performance variables, as determined by trial and error experience with the arrow rest.

The arrow rest of the present invention has a support shaft that can be shifted in a horizontal direction normal to the movement plane of the bowstring, whereby the position of the arrow rest can be adjusted to a desired position precisely aligned with the center of pressure, or some other position, suited to the desires of the individual archer. The shaft adjustment process can be performed quickly in a straight forward fashion. No complicated steps or manipulations are required.

In preferred practice of the present invention, the single roller has a diameter that is approximately twice that of the associated arrow shaft. In one particular construction the roller diameter is about five-eighths (5/8) of an inch; the arrow shaft diameter may be about twenty- sixty-fourths (20/64) of an inch, although arrow shafts of varying diameter can be used. A given arrow support roller can accommodate a range of different arrow shaft diameters.

The roller of the present invention is mounted on a single shaft that extends laterally through a mounting arm that is attached to the bow at a point above the bow handle. The mounting arrangement is designed for use with almost any conventional bow, without modification of the bow. The roller, and its support shaft, are located above the bow handle, such that the person can grip the handle without any concern that his hand might come into contact with the roller. The roller has a relatively small mass and small diameter, whereby the roller does not interfere with normal handling of the bow by the archer.

Lastly, the roller type arrow rest of the present invention is characterized by a relatively low manufacturing cost and a relatively rugged construction, conducive to a long service life and ability to retain any desired position of adjustment.

In summary, and in accordance with the above discussion, the foregoing objectives are achieved in the following embodiments:

1. An arrow rest for an archery bow, comprising:

a mounting arm attachable to a bow above the bow handle; said arm extending downwardly and rearwardly from its bow attachment point;

a shaft extending across said mounting arm; said shaft having an axis extending transverse to the string movement plane of the bow; means for attaching said shaft to said mounting means;

a single roller rotatably mounted on said shaft for free rotation around the shaft axis;

said roller comprising an annular roller body formed of an elastomeric material; said roller body having an annular groove extending in a plane normal to the shaft axis; said annular groove defining two axially spaced flanges having the same diameter; and said flanges having circular edges adapted to rollably engage side surfaces of an arrow during an arrow launch action.

2. The arrow rest, as described in paragraph 1, wherein said roller comprises a sleeve extending through said annular roller body; and said sleeve having a close slidable running fit on said shaft, whereby the roller has a non-wobble spinning motion around the shaft axis during an arrow launch action.

3. The arrow rest, as described in paragraph 2, wherein said sleeve is formed of a plastic material that is harder than the roller body material.

4. The arrow rest, as described in paragraph 2, wherein the sleeve length is materially greater than the sleeve diameter.

5. The arrow rest, as described in paragraph 1, wherein said shaft has a smooth surfaced section extending through said roller, and a threaded section extending through said mounting arm; and a pair of nuts threaded onto the threaded shaft section alongside the mounting arm; and said mounting arm being located between said nuts, whereby said nuts exert clamping forces on said mounting arm.

6. The arrow rest, as described in paragraph 5, wherein the threaded shaft section is longer than the corresponding thickness dimension of the mounting arm; and whereby the nuts can be adjusted along the shaft to vary the position of the roller in a direction transverse to the string movement plane.

7. The arrow rest, as described in paragraph 1, wherein the annular groove in the roller body has a width dimension that is approximately one-half the diameter of an arrow shaft supported by the roller.

8. The arrow rest, as described in paragraph 1, wherein the diameter of each annular flange is approximately twice the diameter of an arrow shaft supported by the roller.

9. The arrow rest, as described in paragraph 1, wherein said annular groove has a width dimension, such that said flanges engage the arrow at two points angled about thirty degrees on either side of a vertical midplane taken through the arrow centerline.

A BRIEF DESCRIPTION OF THE DRAWINGS

DESCRIPTION OF THE PREFERRED EMBODIMENTS OF THE PRESENT INVENTION

Figure 1:
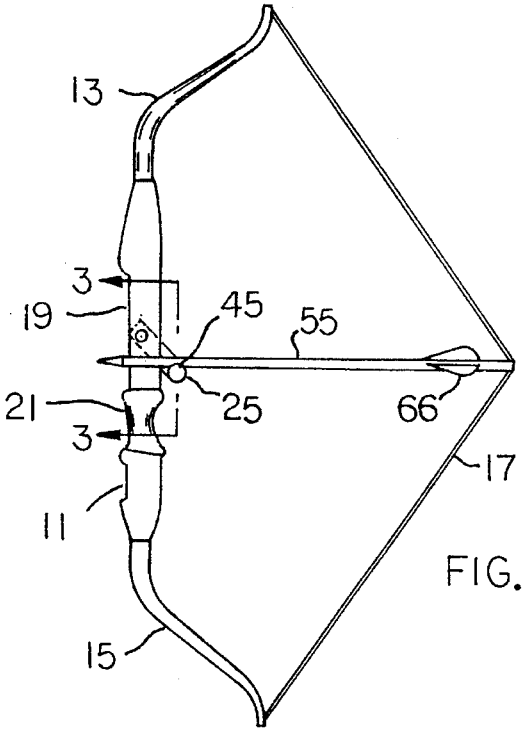
FIG. 1, is a side elevational view, of an archery bow equipped with an arrow rest, constructed according to the present invention.

FIG. 1, is a side elevational view, of an archery bow equipped with an arrow rest, constructed according to the present invention.

The drawings show a conventional bow and arrow system, with the bowstring pulled back to the arrow launch position; the archer's hands are omitted from the drawing. As shown in FIG. 1, the bow comprises a handle riser section 11, an upper limb 13, and a lower limb 15. The bowstring 17 is operatively connected to the free ends of the upper 13, and lower 15, limbs.

Figure 3:
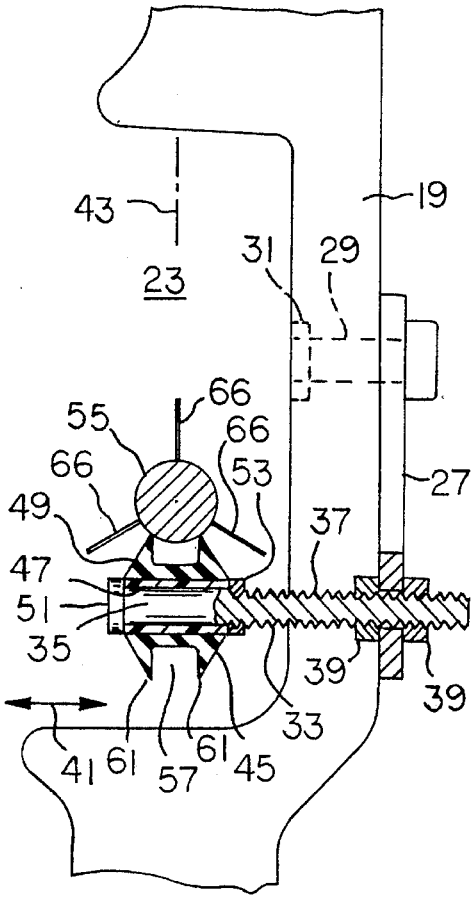
FIG. 3, is an enlarged fragmentary sectional view, taken along line 3—3 in FIG. 1.

Handle riser section 11 comprises a sight window section 19, offset from the movement plane of string 17, and a hand grip (or handle) 21, located immediately below the sight window. In use of the apparatus, the archer directs his view through the sight window space designated generally by numeral 23 (FIG. 3). Often a bow sight is mounted on section 19 of the bow, to aid the archer in aiming the arrow at the target.

Figure 2:
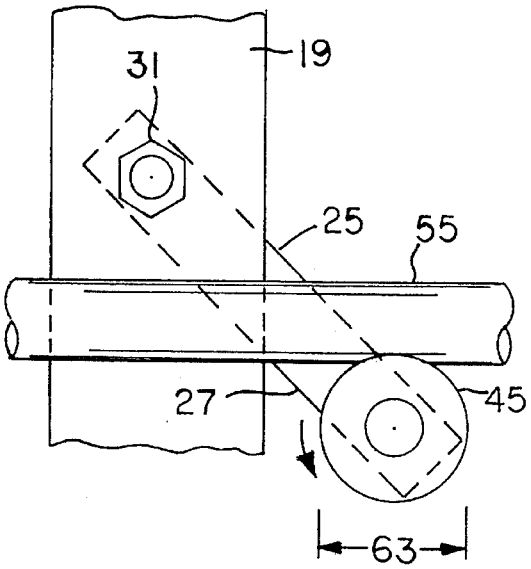
FIG. 2, is a fragmentary enlarged view, taken in the same direction as FIG. 1, but illustrating features not apparent in FIG. 1.

FIG. 2, is a fragmentary enlarged view, taken in the same direction as FIG. 1, but illustrating features not apparent in FIG. 1.

FIG. 3, is an enlarged fragmentary sectional view, taken along lines 3—3 in FIG. 1.

The present invention is concerned more particularly with an arrow rest, designated generally by numeral 25. The arrow rest 25, comprises a mounting arm 27, attachable to sight window section 19 by means of a bolt 29 that extend transversely through aligned holes in the arm and window section; a nut 31 is seated in a hexagonal recess in the bow wall structure to mate with the threaded area of bolt 29. Mounting arm 27 can be a conventional structure known and used prior to the present invention.

As shown in FIG. 2, arm 27 extends rearwardly and downwardly from its bow attachment point. A shaft 33, is adjustably secured to the free end of an, 27. As shown in FIG. 3, shaft 33, comprises a smooth surfaced section 35, and a threaded section 37. The threaded shaft section 37 extends through a circular opening in arm 27, with two nuts 39, being threaded onto section 37, to exert clamping forces on opposite side faces of the arm 27, whereby the shaft 33, is rigidly locked to the arm 27.

Shaft 33, can be adjusted in the direction designated by numeral 41, by loosening the nuts 39, and relocating the nuts 39, to different positions on the shaft 33. The purpose of such an adjustment of the shaft 33, is to change the position of the arrow rest, relative to the movement plane of bowstring 17. In FIG. 3, the bow string movement plane is designated by numeral 43.

The arrow rest further comprises a single roller 45, rotatably mounted on shaft 33, for free rotation around the shaft axis. Roller 45, comprises a sleeve 47, having close slidable running fit on the shaft 33, and an elastomeric roller body 49, bonded to the outer surface of sleeve 47, whereby the sleeve 47, and roller body 49, can rotate as a unit on the stationary shaft 33. The roller 45, is prevented from axial play by means of an enlarged head 51, on the left end of the shaft 33, and an internally threaded ring 53, screwed onto shaft section 37 to abut a shoulder formed at the right end of smoothed surfaced shaft section 35. The axial length of the smooth surfaced section of the shaft, coincides with the axial length of sleeve 47, whereby the roller 45, can rotate freely on the shaft without any axial play, or wobble.

Sleeve 47, is preferably formed of a relatively hard plastic material, e.g. polytetrafluoroethylene, having a relatively low coefficient of friction on the associated shaft. The shaft can be formed of stainless steel, brass, or a rigid plastic (e.g. polytetrafluoroethylene). Dry or viscous lubricant can be provided on the shaft-sleeve interface, to promote free rotation of the roller 45, on the shaft.

Roller body 49, is formed of an elastomeric material having a relatively high durometer, such that the roller body material experiences essentially no deformation when contacted by the arrow 55. The elastomeric body material exerts a grip action on the arrow surface. Therefore, during an arrow launch action the arrow frictionally drives the roller in a rotary spinning fashion, as indicated by the arcuate directional arrow, in FIG. 2. The frictional contact between the arrow 55, and the roller body 49, is essentially noiseless, because of the material used for the roller body 49. The arrow 55, can be a conventional structure formed out of the usual materials employed in arrow construction, e.g. wood, aluminum, or carbon fibers.

Roller body 49, has an annular groove 57, extending in a plane normal to the shaft 33 axis, to define two axially spaced flanges 61. The arrow 55, rests on the edges of these flanges 61, so that there is a relatively small total contact area between the arrow 55, and the roller body 49. Groove 57, has sufficient width, such that the arrow has a stable balanced position on the spaced flanges 61, while the arrow is being drawn back, and while the arrow is being launched. Typically, the axial width of groove 57, is about one-half the diameter of the arrow 55 shaft. However, carbon fiber arrow shafts have relatively small diameters, so that when carbon fiber arrows are used, the dimensional relationships do not apply exactly.

In one particular arrangement, the axial width of groove 57, measured about five-thirty-secondths (5/32) of an inch, and the diameter of the arrow shaft measured about ten-thirty-secondths (10/32) of an inch. The diameter of the roller, indicated by numeral 63, measured about five-eighths (5/8) of an inch. Preferably the roller diameter is approximately twice the arrow shaft diameter. The edges of roller flanges 61, contact the arrow shaft at two spaced points angled at about thirty degrees on either side of a vertical midplane taken through the arrow centerline. With such an arrangement the roller has adequate clearance with respect to the arrow fletches (feathers).

FIG. 3, shows three arrow fletches 66, in relation to the roller displacement. There is sufficient clearance so as to avoid contact between the fletches 66, and the roller 45. At the same time, the roller has sufficient displacement that it can be adequately supported on shaft 33, without wobbling. The axial length of support sleeve 47, can be about one-half inch.

As seen in FIG. 1, roller 45 is located above handle 21. The person can extend his hand around handle 21, without having the hand inadvertently come into contact with the roller 45. The small diameter of the roller 45, contributes vertical compactness to the arrow rest. The small roller diameter also reduces the mass of the roller, which enables the roller to be easily spun by frictional contact with the arrow shaft.

The illustrated arrow rest is relatively compact and inexpensive to produce. Also it can be readily adjusted by moving nuts 39, along shaft 33. The roller rotates in a noiseless fashion during the arrow launch period.

FIG. 3, illustrates a preferred roller configuration useful in practice of the invention. However, other roller configurations can be used.

Figure 4:
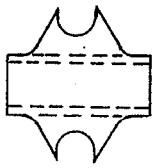
FIG. 4, is an elevational view, of a roller that can be used instead of the roller shown in FIG. 3.

FIG. 4, is an elevational view, of a roller that can be used instead of the roller shown in FIG. 3.

FIG. 4, shows an alternate roller construction, designed to have an increased sleeve area. An advantage of the FIG. 4 construction is that there is less tendency for the roller to wobble. However, the roller has an increased mass, which is a disadvantage. FIG. 3 represents a preferred roller design.

The present invention, described above, relates to an arrow rest. Features of the present invention are recited in the appended claims. The drawings contained herein necessarily depict structural features and embodiments of the arrow rest, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An arrow rest for an archery bow, comprising:

a mounting arm attachable to a bow above the bow handle;

said arm extending downwardly and rearwardly from its bow attachment point;

a shaft extending across said mounting arm;

said shaft having an axis extending transverse to the string movement plane of the bow;

means for attaching said shaft to said mounting arm;

a single roller rotably mounted on said shaft for free rotation around the shaft axis;

said roller comprising a plastic sleeve having a close slidable running fit on said shaft, and an annular roller body bonded to said sleeve, said annular roller body being formed of an elastomeric material;

said roller body having an annular groove extending in a plane normal to the shaft axis;

said annular groove defining two axially spaced flanges having the same diameter;

said flanges having circular edges adapted to rollably engage side surfaces of an arrow during an arrow launch action;

said annular groove defining two parallel radial side surfaces spaced apart by a distance that is approximately one-half the diameter of an arrow supported by the roller, whereby said flanges have line contact with the arrow at two points angled about thirty (30) degrees on either side of a vertical midplane taken through the arrow centerline; and the plastic material for said sleeve being harder than the elastomeric material for said roller body, whereby said roller rolls freely on said shaft, while said roller body grips the arrow to produce a spinning motion of the roller around the shaft axis during an arrow launch action.

* * * * *